US009462652B2

(12) United States Patent
Dunser et al.

(10) Patent No.: US 9,462,652 B2
(45) Date of Patent: Oct. 4, 2016

(54) DEVICE FOR LED OPERATION

(71) Applicants: TRIDONIC GMBH & CO KG; TRIDONIC JENNERSDORF GMBH, Jennersdorf (AT)

(72) Inventors: Mathias Dunser, Feldkirch (AT); Florian Moosmann, Dornbirn (AT); Norbert Kleber, Dornbirn (AT); Christian Nesensohn, Gotzis (AT); Frank Lochmann, Esseratsweiler (DE); Reinhold Juen, Dornbirn (AT); Gunter Marent, Bartholomaberg (AT); Frank Horn, Engi (CH); Peter Pachler, Graz (AT); Steffen Riemer, Krottendorf-Gaisfeld (AT)

(73) Assignees: TRIDONIC GMBH & CO KG, Dornbirn (AT); TRIDONIC JENNERSDORF GMBH, Jennersdorf (AT)

( * ) Notice: Subject to any disclaimer, the term of this patent is extended or adjusted under 35 U.S.C. 154(b) by 0 days.

(21) Appl. No.: 14/761,741

(22) PCT Filed: Jan. 31, 2014

(86) PCT No.: PCT/AT2014/000021

§ 371 (c)(1),
(2) Date: Jul. 17, 2015

(87) PCT Pub. No.: WO2014/146150

PCT Pub. Date: Sep. 25, 2014

(65) Prior Publication Data

US 2015/0351186 A1 Dec. 3, 2015

(30) Foreign Application Priority Data

Jan. 31, 2013 (AT) ..... GM30/2013

(51) Int. Cl.
*H05B 33/08* (2006.01)

(52) U.S. Cl.
CPC ..... *H05B 33/0854* (2013.01); *H05B 33/089* (2013.01); *H05B 33/0851* (2013.01)

(58) Field of Classification Search
CPC ..... H05B 33/0815; H05B 33/0818; H05B 33/0809; H05B 37/029; H05B 37/02; H05B 41/3925; H05B 41/391; H05B 41/2828; H05B 33/0803; G09G 5/10
USPC ..... 315/224, 297; 340/815.5, 693.1; 345/102, 690
See application file for complete search history.

(56) References Cited

U.S. PATENT DOCUMENTS 8,018,425 B2 * 9/2011 Oh ..... H05B 33/0815 313/463
8,319,449 B2 * 11/2012 Hoogzaad ..... H05B 33/0815 315/185 S (Continued)

FOREIGN PATENT DOCUMENTS

| | | |
|---|---|---|
| DE | 10230154 A1 | 1/2004 |
| EP | 1372270 A1 | 12/2003 |
| EP | 2375858 A1 | 10/2011 |

*Primary Examiner* — Douglas W Owens
*Assistant Examiner* — Syed M Kaiser
(74) *Attorney, Agent, or Firm* — Volpe and Koenig, P.C.

(57) ABSTRACT

The invention relates to a method for operating LEDs (13), comprising a driver module (10) and an LED module (11) having at least one LED (13), which LED module (11) is controlled by the driver module (10), wherein the driver module (10) has a first connection (1), which is designed to feed the LED module (11) with a current, and has a second connection (2) is present as earth connection (GND), wherein the LED module (11) is fed with a current by the driver module (10) via a first connection (1) and a second connection (2) is present as earth connection (GND), characterized in that the driver module (10) temporarily lowers the voltage at the first connection (1) and monitors the voltage at the first connection (1) and is designed to evaluate a change in the voltage at said connection as a transfer of information from the LED module (11).

18 Claims, 2 Drawing Sheets

(56) References Cited

U.S. PATENT DOCUMENTS

| | | | | |
|---|---|---|---|---|
| 8,624,828 | B2 * | 1/2014 | Uchimoto | H05B 33/0815 345/102 |
| 2004/0056774 | A1 * | 3/2004 | Schleicher | H05B 33/0848 340/815.45 |
| 2009/0195192 | A1 | 8/2009 | Joseph | |
| 2010/0020108 | A1 * | 1/2010 | Cho | G09G 3/3406 345/690 |
| 2010/0213759 | A1 | 8/2010 | Covaro | |
| 2011/0043133 | A1 * | 2/2011 | Van Laanen | H02M 1/4225 315/294 |
| 2011/0222595 | A1 | 9/2011 | Choi et al. | |
| 2011/0273282 | A1 | 11/2011 | Ohsawa | |

* cited by examiner

DEVICE FOR LED OPERATION

FIELD OF THE INVENTION

The invention relates to a device for operating LEDs and to a method for operating LEDs.

Such devices are used in lighting systems in order to achieve a colored or planar illumination of spaces, paths or escape routes. In this case, the illuminants are usually driven by operating devices and activated as necessary. For such an illumination organic or inorganic light emitting diodes (LEDs) are used as light source.

BACKGROUND

For lighting purposes, instead of gas discharge lamps and incandescent lamps, light emitting diodes are increasingly being used as light source. The efficiency and luminous efficiency of light emitting diodes is being increased to a greater and greater extent, such that they are already used in various applications for general lighting. However, light emitting diodes are spot light sources and emit highly focused light.

Present-day LED lighting system often have the disadvantage, however, that the color emission or the brightness can vary on account of ageing or as a result of replacement of individual LEDs or LED modules. Moreover, the secondary optics influence the thermal management since the heat emission is impeded. Moreover, a variation of the phosphor of the LED can occur on account of ageing and the action of the heat.

SUMMARY

The object of the invention is to provide an illuminant and a method which enable the uniform and true-color illumination of an area by an illuminant with light emitting diodes without the abovementioned disadvantages or with a significant reduction of these disadvantages.

This object is achieved for a device of the generic type according to the invention and for a method according to the invention by means of the characterizing features the independent claims. Particularly advantageous embodiments of the invention are described in the dependent claims.

The solution according to the invention for a device for operating LEDs (organic or inorganic light emitting diodes) is based on the concept that an LED module having at least one LED is driven by a driver module, wherein the LED module is fed with a current by the driver module via a first terminal and a second terminal is present as a ground connection. The LED module has a third terminal, which is embodied as a data channel. The third terminal is connected to the driver module, wherein a voltage fed by the driver module is present on the data channel.

In this way it is possible to achieve a very constant and uniform illumination of an area by an illuminant with light emitting diodes.

BRIEF DESCRIPTION OF THE DRAWINGS

The invention will be explained in greater detail below with reference to the accompanying drawing, in which.

DETAILED DESCRIPTION OF THE PREFERRED EMBODIMENTS

Figure 1:
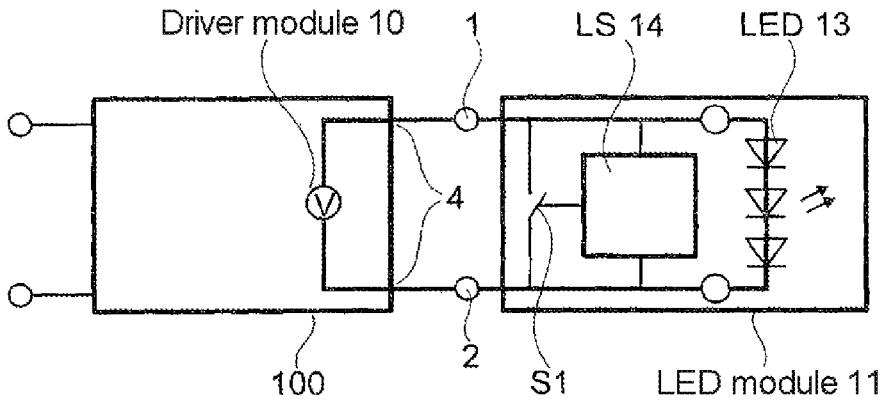
FIG. 1 shows one configuration of an LED module according to the invention

FIG. 1 shows one configuration of the device according to the invention comprising an LED module 11 and a driver module 10.

The invention is explained below on the basis of an exemplary embodiment of a device 100 for operating LEDs 13. Said device comprises a driver module 10, and an LED module 11 having at least one LED 13, said LED module being driven by the driver module 10.

The driver module 10 has a first terminal 1, via which the LED module 11 connected thereto can be fed with a current by the driver module 10. Said current serves for feeding the LED 13. Furthermore, the driver module 10 has a second terminal 2, which is present as a ground connection (GND).

The LED module 11 has a first terminal 1, via which the LED module 11 is fed with a current by the driver module 10, and a second terminal 2 as a ground connection. A plurality of LEDs 13 can be situated on a common LED module 11.

The LED module 11 and also the driver module 10 thus have only two terminals, wherein both energy for feeding the LED 13 and information can be transferred according to the invention. The connection for feeding the LED module 11 is thus simultaneously embodied as a data channel. Therefore, the terminals of the LED module 11 and the driver module 10 are connected to one another.

The terminals of the driver module 10 and of the LED module 11 are connected via the wiring 4. Consequently, a connection for feeding the LED 13 is present alongside a ground connection.

Figure 2A:
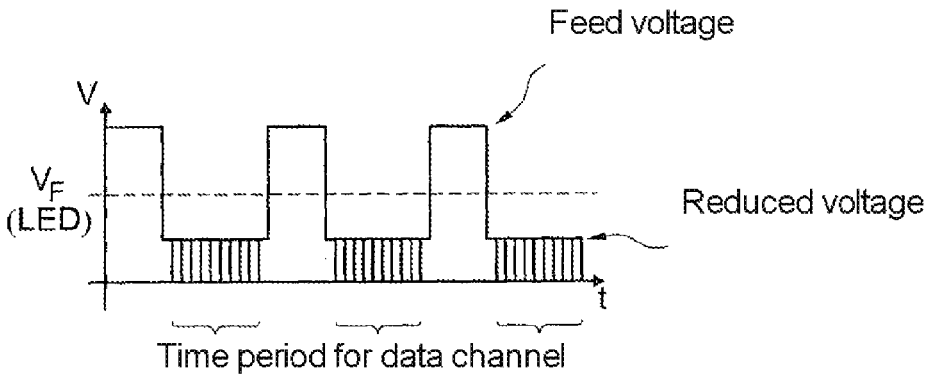
FIG. 2 shows configurations of transfer of information according to the invention
Figure 2B:
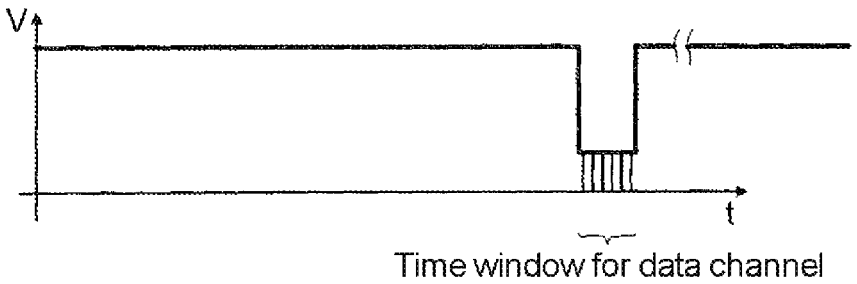

The driver module 10 can temporarily reduce the voltage at the first terminal 1 and monitor the voltage at the first terminal 1, and be designed to evaluate a change in the voltage at said terminal 1 as transfer of information from the LED module 11. The reduced voltage is typically less than the forward voltage (VF) of the LED 13, such that in the phase of the reduced voltage the LED 13 is not active, that is to say luminous. The reduced voltage can be in the region of approximately 5 volts, for example. Consequently, the time range of the reduced voltage is the time period in which the data channel is active. Said time range of the reduced voltage (where the data channel is active), can be activated repeatedly with a low frequency and short time duration, for example with a switch-on ratio of 2 percent in comparison with a time duration of 98 percent for the presence of the feed voltage for the LED 13 (for example at a frequency of 100 or 400 hertz). This sequence is illustrated symbolically in FIG. 2*a*, the time period of the data channel not being depicted in a manner true to scale here for the sake of better illustration. However, the data channel can be activated momentarily for example only in each case after a number of seconds or even minutes (example in FIG. 2*b*).

The LED module 11 can be designed to short-circuit the reduced voltage at the first terminal 1 for the transmission of information. This can be carried out by means of a switch S1, for example, which momentarily short-circuits the first terminal (data channel) with the second terminal (ground connection (GND)).

The information transmitted by the LED module 11 can contain an indication about a parameter of the LED module 11 (for example the rated current or a color locus) or the status of the LED module 11 (a fault, the temperature of the LED or the operating hours).

The reduced voltage can be used for feeding a logic circuit (LS) 14 on the LED module 11. The logic circuit 14 can comprise a microcontroller, for example, which can monitor the voltage at the data channel and can also control the transmission of a signal on the data channel. By way of example, the logic circuit LS 14 can drive a switch S1 which momentarily short-circuits the first terminal 1 with the second terminal (ground connection (GND)).

The reduced voltage can be used for feeding a sensor that is arranged on the LED module 11 or is connected to the LED module 11. The information transmitted by the LED module 11 can include an indication about the status of the sensor or a signal detected by the sensor.

Address information can be transmitted via the data channel. In this way, when a plurality of LED modules 11 are connected to a driver module 10, the individual LED modules 11 can be identified and the LED modules 11 can individually and selectively provide feedback messages (transmit specific information). The information from the LED module 11 can be transmitted after a request by the driver module 10.

The driver module 10 can comprise for example a feed unit, for example a switching regulator, which is designed to feed in both a high voltage for feeding the LED 13 and a reduced voltage at the first terminal 1. However, two feed units can also be present, wherein the first feed unit serves for providing the high voltage for feeding the LED 13 (feed voltage) and a second feed unit can be present for feeding the reduced voltage, wherein it is possible to switch between the two feed units. The switching can be carried out for example by both feed units being decoupled from one another via diodes and being activated only selectively. If the LED module 11 has two feed units, very efficient operation can thereby be made possible in possible standby operation (explained later). The driver module 10 can furthermore have a monitoring circuit for monitoring the voltage at the first terminal 1.

The feeding of the LED 13 with a high voltage can also be carried out in such a way that a specific current is output at the first terminal 1. The driver module 10 can regulate the amplitude of the current. At the same time, however, this current must also be output at a specific voltage in order that the forward voltage (VF) of the LED 13 is attained. Therefore, during operation of the LED 13, a relatively high voltage is present at the LED module 11 (the feed voltage), but the driver module 10 in this case usually regulates to the current that is output.

The driver module 10 can also feed in a reduced voltage and thus keep the data channel active if the LED module 11 is not fed with a feed current for operating the LED 13 by the driver module 10 via the first terminal 1. The LED module 11 can also transmit information if the LED module 11 is not fed with a feed current for operating the LED 13 by the driver module 10 via the first terminal 1. In this regard, the data channel can also be fed with a reduced voltage by the driver module 10 in a standby mode, and a communication between LED module 11 and driver module 10 is also possible in said standby mode.

The LED module 11 can have a memory that can be read by the driver module 10 via the data channel.

The driver module 10 can be designed to monitor the voltage at its output in the time period of the reduced voltage, and a change in the voltage at said output can be evaluated as transfer of information. This evaluation of the voltage at the first terminal 1 can therefore be used for receiving information that was transmitted by the LED module 11.

The driver module 10 can momentarily reduce the voltage at its first terminal 1 and modulate this reduced voltage, preferably in the form of a pulse-modulated signal, in order thus to make available a data channel and in order to transmit information to the LED module 11.

The driver module 10 can regularly read the memory of the LED module 11 and, after replacement of the LED module 11, the memory information read out can be stored in the memory of the new LED module 11. The signaling for reading the memory on the LED module 11 can be effected by the user by means of a switching sequence on the supply voltage, a digital control command or by means of some other signaling. The driver module 10 can also forward the information stored in the memory, after read-out from an LED module 11, via the data channel to other LED modules 11 as well.

The driver module 10 can feed a plurality of LED modules 11 via the same first terminal 1 for feeding with current and exchange information with a plurality of LED modules 11 via the same first terminal 1.

By way of example, one or a plurality of LED modules 11 can be switched off by virtue of corresponding switch-off information being transferred via the data channel to said LED modules 11 and the latter thereupon interrupting the current through the LED 13.

The sensor can be a color sensor (e.g. CCD sensor or a photodiode with color filter). The color sensor can be positioned such that it can receive part of the light emitted by the LED modules 11. The color sensor can be positioned such that it is shielded from ambient light and can receive only light emitted by the LED modules 11. However, the sensor can also be positioned on the reflector of the LED luminaire. The sensor can be positioned such that it directly or indirectly receives the light from the LED 13 of the LED module 11.

The sensor can be a brightness sensor (e.g. a photodiode). The sensor can be an ambient light sensor or an artificial light sensor. The sensor, for example an artificial light sensor can be positioned such that it is shielded from ambient light and can receive only light emitted by the LED modules 11. The sensor can be positioned such that it directly or indirectly receives the light from the LED 13 of the LED module 11. The sensor, preferably as an ambient light sensor, can be positioned such that it can receive only ambient light and is shielded from light emitted by the LED modules 11. Such shielding can be achieved for example by means of a color filter or else by means of a physical separation such as, for example, a type of partition between LED 13 and sensor. The sensor can also be positioned on the reflector of the LED luminaire.

The sensor can also be a presence sensor or motion sensor. Additionally or alternatively, the sensor can also be a temperature sensor. The sensor can also be formed by a combination of a plurality of different sensors. By way of example, a plurality of sensors can be situated in a housing, said sensors being evaluated by common electronics (also possible as a multi-chip arrangement).

A dummy load can also be arranged on the LED module 11, said dummy load being connected to the first terminal 1, wherein said dummy load can load the first terminal 1 in the phase of the reduced voltage and this loading can be evaluated by the driver module 10 as information from the LED module 11.

The dummy load can preferably be formed by a linear current source or a passive component, preferably a resistor. The dummy load can also be designed in such a way that a reduction of the voltage at the first terminal 1 has the effect that the dummy load has a predefined temporal behavior and changes the loading in accordance with a predefined curve. This can be carried out for example by charging or discharging of a capacitor.

The profile of the change in loading can be evaluated by the driver module 10 and the information transferred by the LED module 11 can thus be read out.

The driver module 10 can be designed to receive both analog information, preferably on account of the loading with a dummy load, and digital information, preferably by means of pulse-width-modulated signals, from the LED module 11.

The driver module 10 can be designed to recognize whether a digital transfer (on account of a change in the loading according to a pulse pattern which can be recognized by the coded reduction of the voltage) or an analog transfer is carried out by the LED module 11.

It is thus also possible to construct a luminaire with LED 13, comprising a according to the invention.

A method for operating LEDs 13 is also made possible, wherein an LED module 11 having at least one LED 13 is driven by a driver module 11, and a data channel for transferring information via the LED module 11 is present, wherein the data channel is permanently fed with a voltage by the driver module 10 and the LED module 11 is designed to change, for example short-circuit or reduce by loading, the voltage at the data channel for the transmission of information.

The information from the LED module 11 can be transmitted after a request by the driver module 10.

Figure 2C:
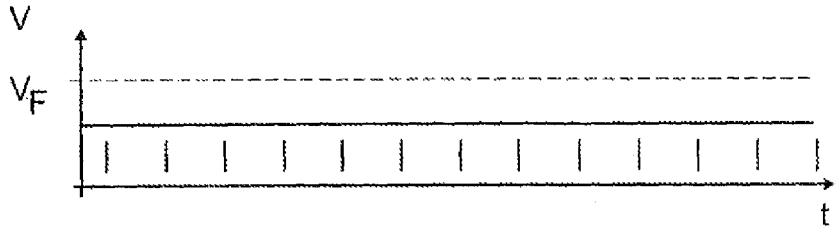

The data channel can also be available in a standby mode or in an initialization phase by virtue of the driver module 10 feeding the first terminal 1 permanently or repeatedly with a reduced voltage, even if no voltage for the operation of the LED 13 is output (see FIG. 2*c*). In this way, a communication between LED module 11 and driver module 10 can also be possible in said standby mode, too; by way of example, the sensor can thus also be read in the standby mode. If the LED module 11 has two feed units, only the second feed unit has to be active in possible standby operation, such that very efficient operation can be made possible. However, it would also be conceivable that, given the presence of only one feed unit, the latter provides the reduced voltage in an adapted operating manner, for example in a burst mode, and this adapted operating mode can also be efficient.

The LED module 11 can have a memory for storing information about the LED module 11, wherein the information in the memory can optionally also be modified. The information in the memory can be modified on the basis of a calibration measurement. The information in the memory can be modified by a correction factor. The correction factor can be dependent on the ageing or the operational duration of the LED module 11. The correction factor can be dependent on the temperature of the LED module 11.

Figure 2D:
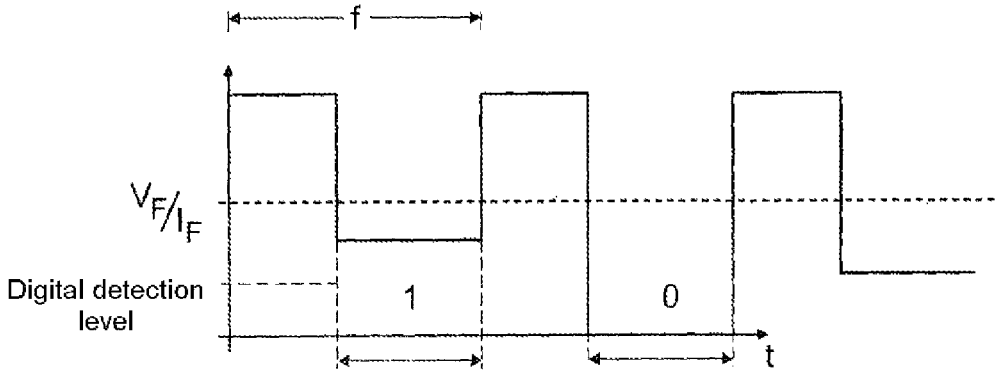
Figure 2E:
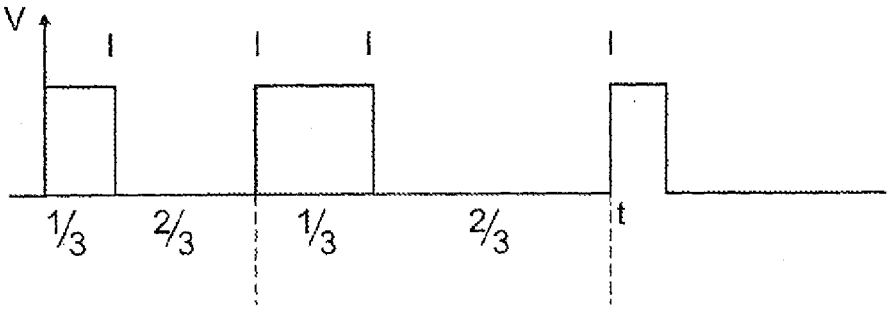

The transfer of information from the driver module 10 to the LED module 11 can also differ from the transfer from the LED module 11 to the driver module 10. By way of example, the LED module 11 can transmit the information during the phase of the reduced voltage, while the driver module 10 transfers its information by means of a pulse modulation of the feed voltage for the operation of the LED 13 (that is to say by modulation of the voltage with a high level (FIG. 2*e*) or by a reduction of the voltage either to zero or the reduced value (e.g. 5 volts) a modulated signal in the phase in which the LED 13 are not fed with a feed voltage (FIG. 2*d*). The latter variant can involve defining a limit voltage (digital detection level), wherein an overshooting of this limit voltage but undershooting of the forward voltage VF is evaluated as a high level (logic 1) and an undershooting of the limit voltage is evaluated as a low level (logic 0) of the signal. The LED module 11 can be designed to recognize when the driver module 10 transfers information, and can restrict its transmission of information to time periods in which the data channel is available as a result of the presence of the reduced voltage, but the driver module 10 transmits no information (this can hold true for various types of transmission by the driver module 10).

The driver module 10 can contain a switching regulator, for example an AC/DC converter. The driver module 10 can contain a PFC (active power factor correction circuit). The driver module 10 can have a potential isolation. The driver module 10 preferably has an interface for user control. Said interface can be designed for example for connection to a light control system such as DALI or DMX, for example.

What is claimed is:

1. A device for operating light emitting diodes (LEDs) (13), comprising a driver module and an LED module (11) having at least one LED (13), said LED module being driven by the driver module, wherein the driver module (10) has a first terminal (1), which is designed for feeding the LED module (11) with a current, and a second terminal (2) as a ground connection (GND), wherein the LED module (11) is fed with a current by the driver module (10) via the first terminal (1) and the second terminal (2) is present as a ground connection (GND), wherein the driver module (10) temporarily reduces a voltage at the first terminal (1) and monitors the voltage at the first terminal (1), and is designed to evaluate a change in the voltage at said first terminal (1) as transfer of information from the LED module (11), and wherein a dummy load is arranged on the LED module (11), said dummy load being connected to the first terminal (1), wherein this dummy load loads the first terminal (1) when the reduced voltage is present and this loading can be evaluated by the driver module (10) as information from the LED module (11), the driver module (10) is configured to be able to receive both analog information, on account of the loading with a dummy load, and digital information, by means of pulse width modulated signals, from the LED module (11).

2. The device for operating LEDs (13), as claimed in claim 1, wherein the LED module (11) is designed, in the phase of the reduced voltage, to short-circuit the first terminal (1) and the second terminal (2) for the transmission of information.

3. The device for operating LEDs (13), as claimed in claim 2, wherein the information transmitted by the LED module (11) contains an indication about a parameter of the LED module (11) or the status of the LED module (11).

4. The device for operating LEDs (13), as claimed in claim 1, wherein the reduced voltage is used for feeding a logic circuit (LS 14) on the LED module (11).

5. The device for operating LEDs (13), as claimed in claim 4, wherein the reduced voltage is used for feeding a sensor which is arranged on the LED module (11) or which is connected to the LED module (11).

6. The device for operating LEDs (13), as claimed in claim 5, wherein the information transmitted by the LED module (11) includes an indication about a status of the sensor or a signal detected by the sensor.

7. The device for operating LEDs (13), as claimed in claim 5, wherein the sensor is a color sensor.

8. The device for operating LEDs (13), as claimed in claim 5, wherein the sensor is a presence sensor or a motion sensor.

9. The device for operating LEDs (13), as claimed in claim 1, wherein address information is transferred as information.

10. The device for operating LEDs (13), as claimed in claim 1, wherein the driver module (10) at least temporarily also feeds a reduced voltage onto the data channel if the LED module (11) is not fed with a current by the driver module (10) via the first terminal (1).

11. The device for operating LEDs (13), as claimed in claim 1, wherein the LED module (11) also transmits information if the LED module (11) is not fed with a current by the driver module (10) via the first terminal (1), but rather is only supplied with the reduced voltage.

12. The device for operating LEDs (13), as claimed in claim 1, wherein the LED module (11) has a memory which can be read by the driver module (10).

13. The device for operating LEDs (13), as claimed in claim 12, wherein the driver module (10) can regularly read the memory of the LED module (11) and, after the replacement of the LED module (11), the memory information read out is stored in the memory of the new LED module (11).

14. The device for operating LEDs (13), as claimed in claim 1, wherein the driver module (10) is designed to modulate the reduced voltage at its first terminal (1).

15. The device for operating LEDs (13), as claimed in claim 1, wherein the driver module (10) can momentarily reduce the voltage at its first terminal (1), preferably in the form of a pulse-modulated signal, in order to transmit information to the LED module (11).

16. The device for operating LEDs (13), as claimed in claim 1, wherein the driver module (10) can feed a plurality of LED modules (11) via the same first terminal (1) for feeding with current and can also exchange information with a plurality of LED modules (11) via the first terminal (1).

17. The device for operating LEDs (13), as claimed in claim 1, wherein the dummy load is formed by a linear current source or a passive component.

18. A device for operating light emitting diodes (LEDs) (13), comprising a driver module and an LED module (11) having at least one LED (13), said LED module being driven by the driver module, wherein the driver module (10) has a first terminal (1), which is designed for feeding the LED module (11) with a current, and a second terminal (2) as a ground connection (GND), wherein the LED module (11) is fed with a current by the driver module (10) via a first terminal (1) and a second terminal (2) is present as a ground connection (GND), wherein the driver module (10) temporarily reduces a voltage at the first terminal (1) and monitors the voltage at the first terminal (1), and is designed to evaluate a change in the voltage at said first terminal (1) as transfer of information from the LED module (11), wherein one or a plurality of LED modules (11) can be switched off by virtue of the fact that corresponding switch-off information is transferred to these LED modules (11) by means of the reduced voltage and said LED modules thereupon interrupt the current through the LED (13).

* * * * *